United States Patent [19]

Salmon et al.

[11] Patent Number: 4,807,723

[45] Date of Patent: Feb. 28, 1989

[54] ELEVATOR ROPING ARRANGEMENT

[75] Inventors: John K. Salmon, South Windsor; William S. Edge, Glastonbury, both of Conn.

[73] Assignee: Otis Elevator Company, Farmington, Conn.

[21] Appl. No.: 542,628

[22] Filed: Oct. 17, 1983

[51] Int. Cl.[4] ..... B66B 11/04

[52] U.S. Cl. ..... 187/20; 254/400

[58] Field of Search ..... 187/20, 27, 22, 23, 187/94; 254/264, 371, 398, 400; 74/505, 506, 10.7, 89.22, 89.2

[56] References Cited

U.S. PATENT DOCUMENTS

| | | | |
|---|---|---|---|
| 1,785,090 | 12/1930 | Jacoby | 254/400 |
| 3,332,665 | 7/1967 | Bruns | 187/20 |
| 3,519,101 | 7/1970 | Sieffert | 187/20 |
| 4,030,569 | 6/1977 | Berkovitz | 187/20 |

FOREIGN PATENT DOCUMENTS

| | | | |
|---|---|---|---|
| 197042 | 4/1908 | Fed. Rep. of Germany | 187/20 |
| 2312449 | 12/1976 | France | 187/20 |
| 358108 | 12/1961 | Switzerland | 254/400 |

*Primary Examiner*—Joseph J. Rolla
*Assistant Examiner*—Kenneth Noland

[57] ABSTRACT

In a traction drive elevator system, the ropes from the counterweight are fed over a secondary or deflection sheave to the bottom of a drive sheave, around the drive sheave for more than 180° and then to the elevator car. The sheaves contain polyurethane inserts for the rope. The draw angles, vertical and horizontal, are 1.5°.

2 Claims, 1 Drawing Sheet

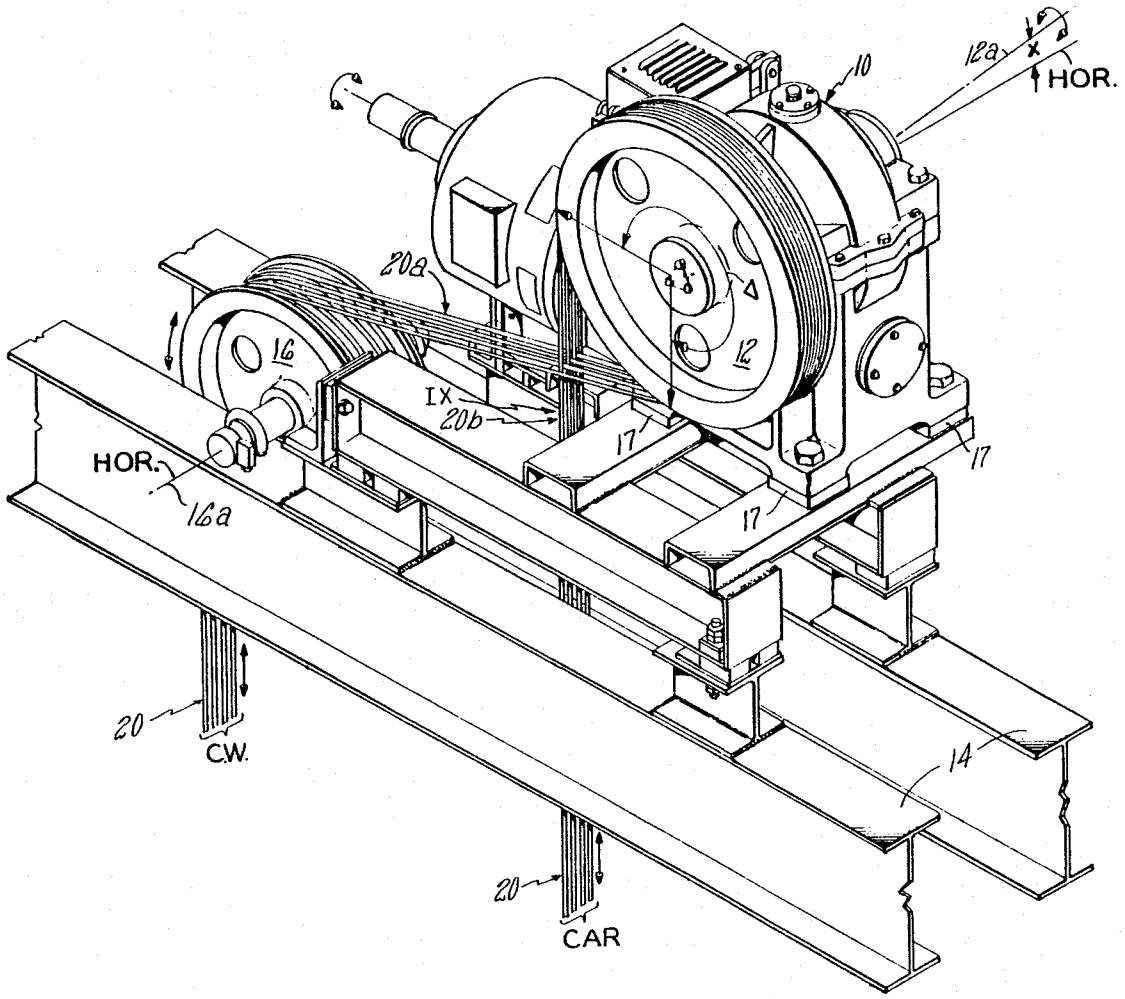
HOR.
12a
10
12
17
17
17
14
20a
20b
IX
16
16a
HOR.
CW.
20
CAR
20

ELEVATOR ROPING ARRANGEMENT

DESCRIPTION

1. Technical Field

This invention relates to traction elevator systems, in particular, improving traction between the rope and the drive.

2. Background Art

In one common type of elevator roping configuration ropes are wrapped for about 180° around a drive sheave that is rotated by the motor. The available traction is obviously dependent on the surface area of the sheave contacted by the rope and the downward force, while the required traction is dependent on the weight of the car and the counterweight and the acceleration. If the downward load is reduced (as it would be if the elevator car and the counterweight weighed less), the required traction (determined by the ratio of the rope loads on each side of the sheave) would increase, and, when it exceeded the available traction, it would give rise to slip, which diminishes efficiency and cable life.

Another arrangement, sometimes known as the double wrap, uses a secondary sheave, also known as a deflection sheave, as part of a rope arrangement in which the ropes are fed from the counterweight over the deflection sheave to the drive sheave, back to the deflection sheave, back to the drive sheave and then down to the car, thus doubling the arc of the ropes on each sheave and thus proportionally increasing the available traction. However, the load on each sheave is also increased because the sum of the rope forces (it determines that load) is also doubled. The arrangement may, by increasing the number of ropes on each sheave, actually increase the loading on the drive sheave, significantly enough to decrease the service life of the bearing components that support the drive sheave and the secondary sheave, and also the life of the rope. Furthermore, the double wrap arrangement is neither compact, nor inexpensive, mainly because the sheaves have to be made twice as large, and because they have to be strong enough to withstand the increased loading that they sustain.

Another arrangement for improving traction is shown in Finnish Patent No. 56813. There, the ropes are wrapped less than 251° around the main drive after passing over a deflection sheave. A problem is, however, that the deflection sheave and the drive sheave are not coplanar, leading to noise and excessive sheave and cable wear.

DISCLOSURE OF INVENTION

According to the instant invention, the ropes are fed from the counterweight through a grooved deflection sheave to the drive sheave. They are then routed around the drive sheave (for more than 250°) and then dropped down to the elevator car. The drive sheave is tipped or skewed slightly relative to the rotational plane of the deflection sheave, and the drive sheave and the deflection sheave have a plastic (nonmetallic) insert that receives the rope.

This arrangement significantly improves available traction without enlarging the size of the sheaves, or increasing the number of wraps. Noise and rope wear are significantly reduced and more rope wrap—hence more traction—is available with a small drive sheave.

BRIEF DESCRIPTION OF DRAWING

The drawing is a perspective view of a geared AC elevator drive embodying the present invention, and it shows multiple ropes which extend into an elevator shaft to connect to a counterweight and a car; however, neither the car, the shaft, nor the counterweight are shown specifically in the drawing.

BEST MODE FOR CARRYING OUT THE INVENTION

The geared AC elevator drive shown in the drawing includes an AC worm gear motor 10, which includes a drive sheave 12, that the motor rotates in order to raise and lower the car. This motor 10 is mounted on a rather straightforward frame arrangement to a pair of beams 14 which span the elevator shaft above the car and counterweight C.W. (The car, counterweight, and the shaft are not specifically shown in the drawing.)

A deflection sheave 16 on the beams 14 rotates about a rotational axis **16*a* which lies basically in the horizontal plane (HOR.) of the beams. On the other hand, the drive sheave 12 rotates about an axis 12*a* which is some angle X vertically displaced from the horizontal plane and axis 16*a*. The drive sheave 12, in other words, is oriented at an angle relative to the rotational plane of the deflection sheave 16 (their rotational planes are not parallel). This offset may be established simply by using tapered support blocks 17 below the motor 10**. The drive sheave and the deflection sheave contain a nonmetallic (e.g. polyurethane) insert INS like the insert shown in U.S. Pat. Nos. 3,279,762 and 4,198,196. These inserts are cleated to improve traction. The insert here, however, need not be cleated to attain satisfactory traction (due to the wrap of more than 250°).

Four ropes 20 extend upward from the counterweight into corresponding grooves on the deflection sheave 16. From the deflection sheave 16 these ropes enter grooves on the bottom of the drive sheave 12. They then pass around the drive sheave for an angular distance Δ (approximately 252° minimum) and from there drop down to the car.

The drive sheave 12 is not only offset with respect to the rotational axis 16, but also not coplanar with the rotational plane of the deflection sheave 16, so that the ropes leaving the drive sheave can drop down between the beams 14. As a result of that location of the drive sheave 12 relative to the deflection sheave 16, and as a result of the offset angle X, the incoming portions **20*a* of the rope are vertically displaced from the departing portions 20*b* that drop down to the car, and it is the offset angle X that permits the portions 20*a* and 20*b* to clear each other, thus giving rise to an "interleaved" rope pattern (at IX) where the portions 20*a* and 20*b*** cross. The angle (draw angle) between the rope and the deflection sheave and the drive sheave is about 1.5°.(In the prior art this is typically 0.7°. This limits the maximum permissible wrap because adjacent ropes must clear each other.) The inserts permit these greater draw angles—however, without increased wear, which would otherwise occur.

The drive shown in the drawing provides a wrap angle Δ of approximately 252° (minimum). That wrap angle could be increased somewhat by raising the deflection sheave vertically, but, so that the portions **20*a* and 20*b* will clear, that may require increasing the offset angle X, and so the vertical draw. But, this is not practical, if required, because the inserts minimize the wear the higher draw produces. There is a disadvantage, however, in increasing the angle X unnecessarily: it increases the side thrust on the drive shaft, and it increases the side loading and friction on the grooves, which may significantly reduce rope life. Obviously, the offset angle X is a function of the size of the drive sheave; a smaller drive sheave will require a larger offset angle, if the portions 20***a*, 20*b* are to clear each other in the area IX. The selection of the offset angle thus must take into account the size of the drive sheave, the permissible thrust on the drive shaft, and the permissible side loading on the drive sheave grooves. The grooves in the drive sheave and the deflection sheave, of course, may contain polyurethane insert material to increase traction and decrease wear.

This particular roping arrangement may, of course, be used in other types of motor drives where it is desired to increase the surface area between the ropes and the drive sheave without increasing the number of wraps. Similarly, the number of ropes which are shown is not particularly significant, and more or less could be used, depending on the system load (counterweight and car).

Other modifications and variations may be made, in whole or in part, to the drive which has been shown, without departing from the true scope and spirit of the invention it embodies.

We claim:

1. An elevator system comprising, a car, a counterweight, a drive unit and a plurality of ropes extending from the counterweight to the car through the drive unit, which drives the rope to move the car within an elevator shaft, characterized by:

the drive unit comprising:

a motor;

a drive sheave; and a deflection sheave;

the drive sheave being driven by the motor, and oriented at a first vertical angle relative to the rotational plane of the deflection sheave and offset a certain distance from the deflection sheave along the deflection sheave axis;

the ropes, in passing through the drive unit, extending from the counterweight to the deflection sheave and from the deflection sheave to the drive sheave at a second horizontal angle relative to the plane of each sheave, then around the drive sheave, and then to the car, the portion of the ropes from the deflection sheave to the drive sheave being adjacent the portions leaving the drive sheave and extending to the car;

the drive sheave and deflection sheave containing a nonmetallic insert in each groove for supporting and guiding the rope in the groove;

the first and second angles being equal.

2. An elevator as described in claim 1, characterized in that said first and second angles are at least 1.5°.

* * * * *